US006447569B1

(12) United States Patent
Sueta

(10) Patent No.: US 6,447,569 B1
(45) Date of Patent: Sep. 10, 2002

(54) DIAMOND CONTAINING EDGE MATERIAL

(76) Inventor: Kimiko Sueta, 11-9, 2 chome, Imado, Taito-ku, Tokyo (JP)

( * ) Notice: Subject to any disclaimer, the term of this patent is extended or adjusted under 35 U.S.C. 154(b) by 0 days.

(21) Appl. No.: 09/614,806

(22) Filed: Jul. 12, 2000

(30) Foreign Application Priority Data

Jul. 14, 1999 (JP) ..... 11-231837

(51) Int. Cl.[7] ..... C22C 1/05; B24D 3/06

(52) U.S. Cl. ..... 75/230; 75/243; 419/11; 419/28; 419/35; 419/38; 51/309

(58) Field of Search ..... 75/230, 243; 419/11, 419/28, 35, 38; 51/309

(56) References Cited

U.S. PATENT DOCUMENTS 3,879,901 A * 4/1975 Caveney
3,912,500 A * 10/1975 Vereschagin et al.
3,929,432 A * 12/1975 Ceveney
4,373,934 A * 2/1983 Hayden
5,030,276 A * 7/1991 Sung et al. ..... 75/237
6,106,957 A * 8/2000 Fang ..... 428/545
6,171,709 B1 * 1/2001 Koizumi et al. ..... 428/545
6,238,280 B1 * 5/2001 Ritt et al. ..... 451/540
6,241,036 B1 * 6/2001 Lovato et al. ..... 175/432

OTHER PUBLICATIONS

Derwent Abstract, JP54163912A, Dec. 1979.*
Derwent Abstract, JP55149172A, Nov. 1980.*
Abstract, JP360128231A, Jul. 1985.*
Derwent Abstract, JP03104566 A, May 1991.*

* cited by examiner

*Primary Examiner*—Ngoclan Mai
(74) *Attorney, Agent, or Firm*—Darby & Darby

(57) ABSTRACT

A blade material, containing diamond particles below about 100 $\mu$m in diameter, is formed as a cutting material where the diamond particles serve as cutting agents while being fixed in a retaining matrix. The retaining matrix substantially includes Titanium or a Titanium alloy containing more than about 50 wt % of Titanium and fixes the diamond particles in place through a multi-step process.

3 Claims, 2 Drawing Sheets

DIAMOND CONTAINING EDGE MATERIAL

BACKGROUND OF THE INVENTION

1. Field of the Invention

The present invention relates to an edge material composed of diamond particles contained in a matrix of pure Titanium or a Titanium alloy containing more than 50 wt % Titanium. This diamond containing edge material or composition may be used as cutting edge for many types of bladed tools.

2. Description of the Related Art

Manufacturers of cutting tools, particularly in the filed of cutlery, have continually attempted to create a blade material having both a sharp edge and the ability to retain that sharp edge during extended and repeated use.

Manufactures have focused on creating materials with a high hardness in attempts to retain a sharp edge. Hardness is commonly defined as a means of specifying the resistance of a material to deformation, scratching, erosion, or oxidation. Hardness is an important feature in a bladed tool since the tool edge is subject to a wearing abrasion from the medium being worked or the surface being worked upon. For example, cutting boards, animal bones, and tough organic matter all act to abrade a tool's edge and to hence make it dull. Manufacturers have frequently used carbon steel to achieve a blade material with relatively high hardness and edge holding ability during initial use.

Manufacturers have also focused on creating a blade material that resists wear in an attempt to achieve a blade edge that does not become dull after repeated use. Toughness is a measure of a materials resistance to repeated stress or wear without failure. Manufacturers have also frequently used ferrous alloys to provide toughness. Many steel alloys are commonly know to have a high relative toughness while maintaining a sharp edge and have thus been frequently used to make the tool edges in knives, scissors, or other cutlery blades.

Manufacturers have also focused on creating a blade material that resists oxidation in use and discoloration of the cutting medium. Manufacturers have experimented with various stainless steel alloys containing Molybdenum, Vanadium, and other elements in attempts to achieve this goal. In sum, manufacturers have frequently looked to both high carbon and stainless steel for a beneficial compromise between sharpness, toughness, and resistance to oxidation.

Recently, manufacturers have begun using ceramic compositions as blade material. Ceramics are attractive candidates for blade material in wear applications because of their high strength, relative hardness, and chemical inertness. The ceramic compositions used by manufacturers include Zirconia, Alumina, and compositions containing Zirconia ceramic and Titanium alloy. Unfortunately, while ceramic compositions have the benefit of high initial hardness they have a relative low toughness and are frequently found to be brittle in use. As a result, ceramic tool blades used in cutlery or scissors frequently break under to brittle failure and are incapable of being sharpened by a common owner.

Through use, manufacturers have found that in cutlery, a continued sharpness is not directly related to the hardness of the cutlery tool. For example, an edge material of Zirconia, with a hardness over 1200 HV (Vickers Harness), is not superior in use to a high hardness steel alloy such as SUS steel, with a hardness in the range of 700 HV, because the Zirconia cutting edge is quickly nicked during use. Thus, manufactures have found that ceramic blades, while having high hardness, also have a low toughness under stress and are generally unsuitable for use in cutlery. Thus, with both steel and ceramic blade materials, manufacturers were limited by the strengths and weakness of each and have sought a necessary compromise to combine the hardness of a ceramic with the strength of a steel alloy in an edge material.

Diamond is a ceramic material with a very relative high hardness. In the past, manufacturers did not generally experiment with diamond as a cutting edge for cutlery items because of cost, inability to sharpen after initial formation or use, the difficulty of initial formation into a workable cutting-edge shape, and several other concerns. Due to these negative features, diamond has generally only found use as an abrasive material adhered to rotary saw blades, contained within an abrasive sharpening stone, or used as a powder applied to a flat surface for polishing.

The present invention attempts to bypass the limitations of both of the above-described materials and to maximize the strengths of both materials.

OBJECTS AND SUMMARY OF THE INVENTION

It is an object of the present invention to provide a material that may be used in bladed cutlery tools, such as kitchen knives, portable knives, scissors, and razors.

It is another object of the present invention to provide a material incorporating diamond into a bladed cutlery edge.

It is another object of the present invention to provide a cutlery edge containing diamond in a substantially pure Titanium matrix.

It is another object of the present invention to provide a cutlery edge containing diamond in a Titanium alloy matrix containing variable amounts of pure Titanium with other metal alloys.

It is another object of the present invention to provide a cutlery edge including diamonds of a particle size generally less then 100 $\mu$m.

It is another object of the present invention to provide a cutlery edge material including diamonds of a particle size distribution selectable according to the kind of material to be cut by the blade edge of the cutlery.

It is another object of the present invention to provide a cutlery edge material formed by mixing diamond in a Titanium based matrix molded under pressure to form an edge portion that is later sintered and subjected to an edge processing.

It is another object of the present invention to provide a tool edge for use in cutlery where edge nicking or tipping is minimized relative to the useful hardness and elasticity of the edge. It should be understood that edge tipping or nicking are substantially the same process resulting in minor damage to a cutting edge.

It is another object of the present invention to provide a method for creating a diamond containing edge material.

The present invention relates to a blade material including diamond particles below about 100 $\mu$m diameter serving as cutting agents while fixed in a retaining matrix. The diamond particles are formed at the blade edge through sintering and edge processing process. The diamond particles are fixed in place with a matrix of Titanium, or with a Titanium alloy containing more than about 50 wt % of Titanium.

According to an embodiment of the present invention there is provided an edge material comprising: a plurality of ceramic particles, a matrix material, the matrix material being at least 50.00 weight percent Titanium, and the matrix material substantially retaining the ceramic particles after sintering.

According to another embodiment of the present invention there is provided an edge material wherein: the ceramic particles have a particle size distribution, the particle size distribution being less than about 100 μm.

According to another embodiment of the present invention there is provided an edge material wherein: the ceramic particles include at least diamond particles.

According to another embodiment of the present invention there is provided an edge material wherein: the diamond particles are at least partially coated with a Nickel alloy.

According to another embodiment of the present invention there is provided an edge material wherein: the ceramic particles are from about 5–50 weight percent of the edge material, and the matrix material is from about 50–95 weight percent of the edge material.

According to another embodiment of the present invention there is provided an edge material wherein: the matrix material includes about 50.1 wt % Titanium and 49.9 wt % Nickel alloy.

According to another embodiment of the present invention there is provided an edge material wherein: the matrix material includes about 90.0 wt % Titanium, 6.0 wt % Aluminum, and 4.0 wt % Vanadium.

According to another embodiment of the present invention there is provided a method for preparing an edge material, comprising the steps of: selecting diamond particles of a predetermined desired size, selecting a metallic material of a type bondable to the diamond particles, mixing the diamond particles with the metallic material to form a composition, filling a mold with the composition, molding the composition under pressure into a predetermined shape, sintering the shape at a temperature below about 1300° C. in a nonoxidizing atmosphere creating the edge material, and processing the edge material to a desired form.

According to another embodiment of the present invention there is provided a method for preparing an edge material, further comprising the steps of: affixing the edge material to at least one external surface.

According to another embodiment of the present invention there is provided a method for preparing an edge material, wherein the step of selecting a metallic material further includes the steps of: determining an alloy composition having at least a partial chemical attraction to the diamond particles, and processing the alloy composition in to a powder.

According to another embodiment of the present invention there is provided a method for preparing an edge material, wherein the step of selecting diamond particles further includes the steps of: determining a desired particle size distribution of the diamond particles below a maximum size of about 100 μm.

According to another embodiment of the present invention there is provided a method for preparing an edge material, wherein the step of selecting diamond particles further includes the step of: coating at least partially the diamond particles with a nickel coating.

According to another embodiment of the present invention there is provided a method for preparing an edge material, wherein the step of processing the edge material further includes the step of: exposing the diamond particles to form a cutting edge on the edge material.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

According to the present invention, a blade material includes a composition in which diamond particles having a diameter below about 100 μm are combined in a Titanium based matrix. The matrix functions as a holding medium for securing the diamond particles during formation, sintering, processing, and later use.

Figure 1:
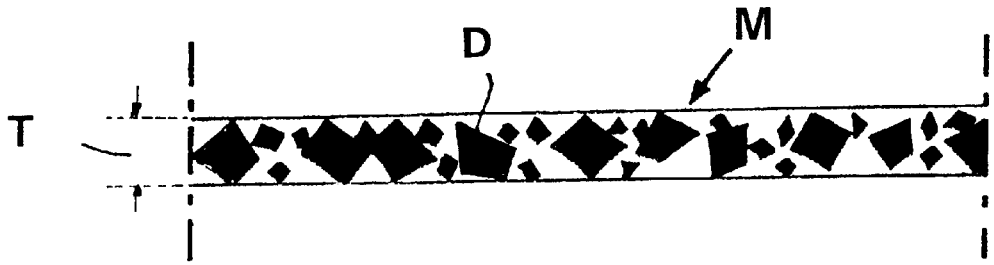
FIG. 1 is a schematic showing an enlarged edge face of a blade material according to the present invention.
Figure 2:
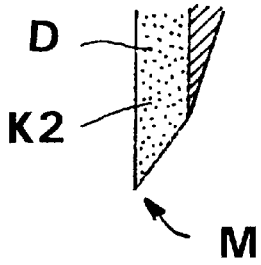
FIG. 2 is a enlarged partial cross section view of a cutting edge according to the present invention.

Referring now to FIGS. 1 and 2, a cutting material blade edge M, having a thickness T, includes multiple diamond particles D held in a rigid matrix. Diamond particles D, selected for inclusion in the cutting material, are at or below about 100 μm in size. Accordingly, thickness T of blade edge M is at or below about 100 μm. The diamond particle size was selected to achieve a suitable cutting quality against relatively soft cutting materials, such as food. If particle sizes above about 100 μm are included in the blade edge M, cutting quality for food degrades and is generally unsatisfactory for cutlery. Larger particle sizes are useful for harder materials, i.e. leather, paper, wood.

The total amount of diamond particles in the blade material by weight is adjustable by a manufacturer according to the kinds of material to be cut by the blade edge. A range of 5–50 weight percent (wt %) of diamond particles to the entire blade material is generally appropriate for normal consumer use as cutlery. Blade material containing below about 5 wt % diamond particles is generally insufficient to provide superior cutting quality is included within this application. Blade material containing above about 50 wt % diamond 100 μm particles is generally insufficient in toughness to retain the diamond particles in the Titanium based matrix under severe consumer use. However, it is to be understood that by adjusting the size, the particle size distribution of the diamond particles, or the alloy composition of the matrix, the holding power or ability of the matrix to retain the diamond particles above about 50 wt % may be increased to achieve tightly bonded diamond particles within the blade material.

In addition to the diamond particles, the blade material matrix may contain Titanium metal, or an alloy containing Titanium at more than 50 wt % of the holding matrix. Alternatively, other suitable alloy powders may be mixed with the Titanium matrix to contain and retain the diamond powder within the matrix.

According to an embodiment of the present invention there are provided the below examples identifying alloy compositions used to form an initial matrix to hold the diamond particles. It is to be understood, that the use of the word matrix, identifying the matrix holding the diamond particles, may also be referred to as a medium for holding the diamond particles. In each example, the metal alloy powder contains more that 50 wt % of Titanium.

EXAMPLE 1

The first example shown below describes the makeup of an experimental blank for material processing and testing. The various weight percentages (wt %) and volume rate percentages (v %) shown below are accurate only to the significant digits displayed.

| | |
|---|---|
| Blade Material total weight = | 4.245 grams (100 wt %, 100 v %), including: |
| Diamond Powder = | 0.875 grams (21 wt %, 25 v %) |
| Mixed Alloy = | 3.370 grams (79 wt %, 75 v %) |

Mixed Alloy composition: (in initial powder form) composing the above total.

| | |
|---|---|
| Aluminum = | 6 wt % |
| Vanadium = | 4 wt % |
| Titanium = | 90 wt % |

EXAMPLE 2

The second example shown below describes the makeup of an experimental blank for material processing and testing. The various weight percentages (wt %) and volume rate percentages (v %) shown below are accurate only to the significant digits displayed.

| | |
|---|---|
| Blade Material total weight = | 4.245 grams (100 wt %, 100 v %), including: |
| Diamond Powder = | 0.875 grams (21 wt %, 25 v %) |
| Mixed Alloy = | 3.370 grams (79 wt %, 75 v %) |

Mixed Alloy composition: (in initial powder form) composing the above total.

| | |
|---|---|
| Nickel = | 49.9 wt % |
| Titanium = | 50.1 wt % |

Note 1 : The ratio of Titanium wt % material to other wt % material is 50.1:49.9
Note 2: The volume rate of alloy powder against the total volume is 50.1%

In each experiment above, the metal alloy was prepared in a powder form for easy mixing and later processing. After the metal alloy was prepared, the diamond powder was added to the now combined powdered alloys and mixed. As a result, the diamond powder was substantially uniformly dispersed throughout the blade material prior to processing.

The mixing weight percent (wt %) of diamond powder within the blade material can be adjusted according to the type of food or other material being cut. While a preferred blade material includes about 21 wt % diamond powder for common cutlery, as disclosed above, the wt % of diamond particles within the blade material gives also satisfactory results for a wider range of materials within the range of about 5–50 wt %. As a result of these experiments, blade materials containing below about 5 wt % diamond particles were found to have generally undesirable holding quality to be used as common cutlery or to have an economic benefit to manufacturer making a potentially competitive cutlery product. On the other hand, blade materials containing more than about 50 wt % diamond particles had a Titanium matrix with generally insufficient holding power to withstand the expected vigorous commercial use. In sum, blade materials including from about 5–50 wt % diamond powder were found to be satisfactory to achieve the desired results. However, other compounds outside the range of 5–50 wt % may easily be created by this process according to specialized customer need or manufacturer desire. As a result, it is to be understood that this disclosure includes ranges outside the 5–50 wt % listed above.

As a result of the above experiments and others, metal alloys containing Titanium were found to have a beneficial chemical attraction to the diamond particles and hence support the formation of a strong matrix. Additionally, it was found that Titanium alloys had a very strong chemical attraction to diamond particles that had been subjected to previous Nickel coating. It was also found that Titanium alloys containing Nickel provide good bonding to diamond particles. As a result, the above metal alloy containing Nickel was found to aid formation of a strong bond between the metal alloy matrix and the diamond powder.

Each above examples was prepared as a mixed composition and placed in a mold having a desired shape. The composition was then molded under pressure and substantially sintered in a furnace under a vacuum or an inert gas sufficient to substantially prevent an oxidizing atmosphere. Sintering was normally conducted at a temperature at or below about 1300 degrees C. to avoid degradation of the diamond powder and alloy matrix.

After sintering, each composition was removed from the mold and processed by edge processing techniques. As a result of edge processing, the diamond particles are substantially fixed along a row and within a maximum width or thickness of about 100 $\mu$m. Thus, a very sharp blade edge is formed since each diamond particle serves as a cutting edge. Additionally, the now substantially sintered Titanium or Titanium alloy form a holding matrix between the diamond particles thus allowing relative elasticity and toughness of the cutting edge thus reducing the generation of tipps or nicks along the edge. Therefore, a sharp cutting edge is created through a combination of very hard diamond particles and tough flexible Titanium based alloy.

Frequently, blade materials produced by powder metallurgy have a reduced edge quality through the formation of minute tipping or edge nicking. The generation of such minute tipping or nicking is influenced by the elasticity of the edge portion that has undergone sintering and edge processing. The elasticity may be equated to quality by a customer and experiments were conduced covering various cutlery materials.

Figure 3:
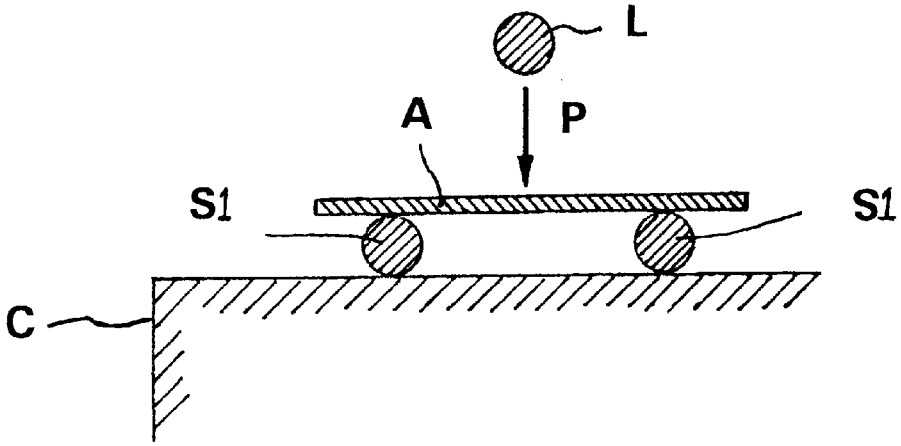
FIG. 3 is a sectional view showing a test apparatus for measurement of strength of a blade material according to the present invention.

As shown in FIG. 3, an elasticity or toughness testing apparatus is shown including a surface plate C for supporting the test apparatus and a round bar L for applying a load to the test apparatus. Also included are round bars S1 for supporting a test piece A that is subjected to a load P in testing. Testing was conducted using the blade material of Example 1, shown above, and a Zirconia ceramic knife blade. Upon testing, a mean load was measured at failure to determine relative elasticity or toughness of the test piece A.

The blade material of Example 1 failed at a load of about 4.0 kg/mm$^2$ at room temperature. The blade material of Example 1 failed at a load of about 6.0 kg/mm$^2$ when it was subjected to load (hammering) under a red heat. The Zirconia ceramic blade material failed at about 3.0 kg/mm$^2$. As a result, a blade material in Experiment 1 is about 1.3 to 2 times as elastic or tough as the blade material in the Zirconia-ceramic. Thus the blade material of this invention will have lower tipping or nicking upon use and will thus last a longer period of time under normal ware.

Figure 4:
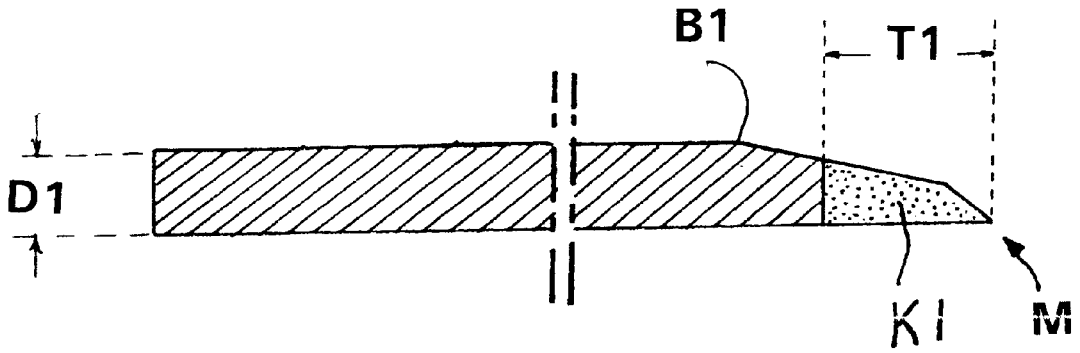
FIG. 4 is an enlarged cross section of an embodiment of a cutting edge according to the present invention.

Additionally referring now to FIG. 4, a cross section of a paper cutter blade with a plate portion B1, with a thickness D1 of 1.5 mm, and employing a blade material portion K1 of the present invention. Blade material portion K1 is a composition of diamond powder and substantially pure Titanium or Titanium alloy and has a height T1. Blade material portion K1 was formed, by molding and sintering at substantially the same time followed by an edge processing step. Here, edge processing has taken place at an angle of about 15 degrees from a blade edge M relative to the page horizontal.

Figure 5:
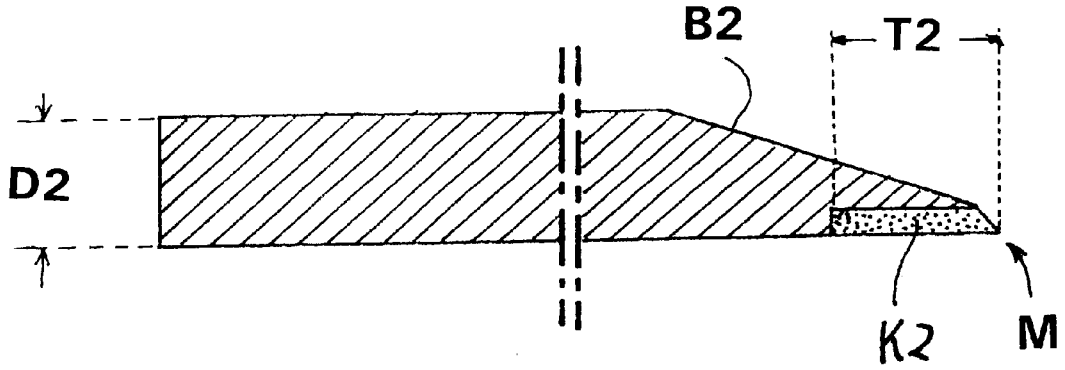
FIG. 5 is an enlarged cross section of another embodiment of a cutting edge according to the present invention.

Additionally referring now to FIG. 5, a cross section of a kitchen knife with a plate portion B2, with a thickness D2 of 3.0 mm, employing a blade material portion K2 of the present invention having a thickness of 0.3 mm and a height T2 of about 10.0 mm. Blade material portion K2 is composed of diamond powder and substantially pure Titanium or Titanium alloy. Blade material portion K2 is formed, as indicated above, by molding and sintering at substantially the same time followed by edge processing. Plate portion B2 is formed as an irregular polygon having a tapered face. The tapered face of plate portion B2 is inclined at an angle of 6 degrees relative to the page horizontal. Blade material portion K2 has a front edge with an angle of about 15 degrees from blade edge M relative to the page horizontal.

Blade material portions K1 and K2 are formed by the manufacturer according to their intended uses. As a paper cutter, blade material portion K1 will be much longer than a kitchen blade and subject to substantially more edge pressure and wear while cutting thick paper bundles. As a result, blade material portion K1 is thicker than blade material portion K2. As part of a kitchen knife, blade material portion K2 must have a hard edge but may be formed thinly to reduce cost while maintaining the sharpness desired by customers.

Thus a blade material according to the above invention may be produced having a hard and tough useful edge that will retain a sharp edge and resist nicking and tipping. Additionally, since the blade material matrix or medium is a composition of Titanium or substantially Titanium alloy, the blade material resists oxidation and is light in weight and easily formed to a desired shape.

It is to be understood that while the diamond particle size of about 100 $\mu$m has been chosen to optimize cutting quality in the present soft cutting mediums, a smaller or larger maximum particle size may be substituted where the cutting material is softer or harder respectively. Additionally, a specially chosen particle distribution (i.e. bimodal or trimodal) may be used in special circumstances dictated by the manufacturer or customer.

It is also to be understood that the diamond particles or powder may or may not be oriented during the edge formation and processing steps. Additionally, it should also be understood that the diamond particles may be specially formed and created in a pre-combination step, in order to create an blade material having a sharper edge than one made with irregularly dispersed diamond particles.

It is to be understood that ceramic particles containing high wt % carbon, or having substantially similar hardness or toughness factors as diamond, may be readily substituted for the diamond particles of the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An edge material comprising:

a plurality of diamond particles at least partially coated with a nickel alloy and having a particle size distribution of maximum size of about 100 um;

a matrix material substantially retaining said particles after processing, said matrix material being about 50–95 percent by weight of said edge material and being at least 50.00 percent Titanium;

said particles being about 5–50 percent of said edge material;

said matrix material including about 50.1 weight percent Titanium and 49 weight percent Nickel.

2. An edge material comprising:

a plurality of diamond particles at least partially coated with a nickel alloy and having a particle size distribution of maximum size of about 100 um;

a matrix material substantially retaining said particles after processing, said matrix material being about 50–95 percent by weight of said edge material and being at least 50.00 percent Titanium;

said particles being about 5–50 percent of said edge material;

said matrix material including about 90.0 weight percent Titanium, 6.0 weight percent Aluminum and 4.0 weight percent Vanadium.

3. A method for preparing an edge material comprising the steps of:

selecting diamond particles having a desired particle size distribution below a maximum size of about 100 um;

coating at least partially said particles with a nickel coating;

selecting a metallic material of a type bondable to said particles, said material being an alloy having at least a chemical attraction to said particles;

processing said alloy to a powder;

mixing said particles with said powders to form a composition;

filling a mold with said composition;

molding said composition under pressure into a predetermined shape;

sintering said shape to a temperature below about 1300 degrees C. in a nonoxidizing atmosphere substantially forming said edge material;

processing said edge material to a desired shape;

affixing said edge material to at least one external support surface, said particles forming a cutting edge on said material.

* * * * *